US005723840A

United States Patent [19]

Bojic et al.

[11] Patent Number: 5,723,840

[45] Date of Patent: Mar. 3, 1998

[54] GAS-DIELECTRIC HIGH-TENSION INTERRUPTER OF THE ARC-PUFFER TYPE

[75] Inventors: Predrag Bojic; Sergio Rizzo, both of Genoa, Italy

[73] Assignee: Ansaldo Industria S.p.A., Genoa, Italy

[21] Appl. No.: 642,331

[22] Filed: May 3, 1996

[30] Foreign Application Priority Data

May 4, 1995 [EP] European Pat. Off. ..... 95830180

[51] Int. Cl.[6] ..... H01H 33/88

[52] U.S. Cl. ..... 218/60; 218/61; 218/57

[58] Field of Search ..... 218/57, 58, 59, 218/60, 61, 65, 66, 145, 84; 200/82 B, 82 R

[56] References Cited

U.S. PATENT DOCUMENTS

| | | | |
|---|---|---|---|
| 3,946,183 | 3/1976 | Milianowicz | 218/66 |
| 4,000,387 | 12/1976 | Milianowicz | 218/61 |
| 4,075,447 | 2/1978 | Rostron | 218/65 |
| 4,095,068 | 6/1978 | Meyer et al. | 218/58 |
| 4,160,888 | 7/1979 | Natsui et al. | 200/148 A |
| 4,163,131 | 7/1979 | Perkins | 200/82 R |
| 4,205,208 | 5/1980 | Calvino | 218/4 |
| 4,241,240 | 12/1980 | Bernatt | 218/2 |
| 4,393,290 | 7/1983 | Mittelbach et al. | 218/65 |
| 4,450,330 | 5/1984 | Zuckler | 200/148 A |
| 4,598,188 | 7/1986 | Schotzau et al. | 200/148 A |
| 4,628,164 | 12/1986 | Taldo | 218/65 |
| 4,841,108 | 6/1989 | Hamm | 218/57 |
| 5,059,753 | 10/1991 | Hamm | 218/84 |

FOREIGN PATENT DOCUMENTS 0 109 806 12/1980 European Pat. Off. .

*Primary Examiner*—Adolf Berhane

*Attorney, Agent, or Firm*—Brinks Hofer Gilson & Lione

[57] ABSTRACT

A gas-dielectric high-tension interrupter of the arc-puffer type in which the puff of gas is brought about by the combined effect of an excess pressure developed in a compression chamber and intensified by the heating caused by the arc radiation, which is optically guided from an arcing chamber to the compression chamber, and of the vacuum developed in a suction chamber which is put into communication with the arcing chamber at a predetermined minimum arcing time (TAM).

8 Claims, 5 Drawing Sheets

GAS-DIELECTRIC HIGH-TENSION INTERRUPTER OF THE ARC-PUFFER TYPE

BACKGROUND OF THE INVENTION

The present invention relates to high-tension AC interrupters of the so-called puffer type with a gas dielectric, generally sulphur hexafluoride ($SF_6$).

In these interrupters, the operation of drive members, generally hydraulic actuators, opens a movable contact and moves it rapidly away from a fixed contact. An electric arc is then developed between the two contacts and ionises the medium (gas) through which it passes. When the current crosses its natural zero, the arc is extinguished only if two conditions occur:

a) the voltage gradient between the contacts must be less than the dielectric strength of the interposed insulating medium (gas); this is achieved by ensuring a suitable distance between the open contacts;

b) the insulating medium must have regained its dielectric characteristics, that is, it must be deionized.

To satisfy this condition, a flow is imparted to the insulating gas in the region in which the arc develops, renovating the gas by replacing the ionized gas with non-ionized gas.

The gas-flow also has the function of modifying the path of the arc and cooling the elements directly exposed to the arc.

High-tension interrupters are known in which, in order to impart a flow to the insulating gas, the contacts are housed in casings filled with gas with a high dielectric strength and the movable contact is fixed to a compression cylinder coupled to a fixed piston to form a compression chamber communicating with an arcing chamber through suitable holes.

The opening of the movable contact brings about a reduction in the volume of the compression chamber and a consequent excess pressure of the gas housed therein in comparison with the exterior and with the arcing chamber.

As a result of this excess pressure, a first gas-flow is developed transverse the arc from the compression chamber to the arcing chamber and from there towards the space in the casing through a hollow operating shaft of the movable contact and, with a certain delay, a second flow is also developed longitudinally of the arc through a nozzle formed in an insulating body fixed to the movable contact and defining the arcing chamber, the nozzle opening during the final stage of the movement of the movable contact away from the fixed contact.

For this reason, these interrupters are also called double-flow interrupters.

A limitation of these interrupters is that, in practice, the flow-rate characteristics over time of the flows for extinguishing the arc are independent of the intensity of the current to be interrupted and depend exclusively upon the geometry of the device and upon the opening dynamics.

An arc-extinguishing flow is initiated even before the opening of the contacts and the consequent formation of the arc, with resulting volumetric wastage. Moreover, the flow has a gradually increasing flow-rate with values which are very low initially and are high only during the final stage of the opening of the contacts.

When currents of high intensity, typically short-circuit currents, are to be interrupted, flow conditions adequate to extinguish the arc are thus achieved a fairly long time after the moment at which the contacts open and after the striking of the arc, to the detriment of the contacts, the insulating body which forms the arc-extinguishing chamber, and the network to be protected.

For interrupting currents of low intensity, on the other hand, particularly if the load is inductive or capacitive, the phenomenon known as splitting of the arc may occur with the development of sudden and dangerous transient voltages which may lead to the re-striking of the arc because it was extinguished when the contacts were not yet sufficiently far apart.

Various distinct approaches have been proposed for improving the efficiency of these interrupters.

According to a first approach, known as the puffer and suction type which is discussed, for example, in Natsui et Al: "Interrupting characteristics of puffer and suction type $SF_6$ gas interrupters, especially in thermal breakdown region" in IEEE Transactions on Power Apparatus & Systems; Vol. PAS-103 No. 4, April 1984, instead of opening into the volume of gas in the casing, the cavity in the operating rod of the movable contact which forms the arcing chamber communicates with a suction chamber formed between a fixed cylinder and a movable piston fixed to the operating rod so that the arc-extinguishing flow is brought about by the pressure differential which exists between the two chambers, that is, the compression chamber and the suction chamber, and which is established very quickly after the start of the operation to open the contacts.

The flow conditions which enable the arc to be extinguished are thus achieved very quickly but the distribution of the flow in time is also not optimal in this case, since it reaches values adequate to extinguish the arc only during the final stage of the operation to open the interrupter and, to a large extent, is wasted during the initial stage of the opening of the contacts.

Moreover, during the interruption of weak currents, the flow which is established from the first moment of the opening of the contact may cause damaging arc-splitting effects, whereas when strong currents are being interrupted it is in any case ineffective and wasted.

In this type of interrupter, the puffer effect is, in practice, independent of the intensity of the current to be interrupted.

According to a second approach, called the hybrid approach, which is discussed, for example, in the document "Development of novel hybrid puffer interrupting chamber for $SF_6$ gas circuit breaker, utilizing self pressure rise phenomena by arc" in IEEE Transactions on Power Delivery, Vol 4 No. 1, January 1989, p. 355–367, the cavity in the operating rod or arcing chamber which, in a double-flow puffer interrupter, is in communication with the volume of gas in the casing, is put into communication with the compression chamber and is shut off from the volume of gas in the casing during the initial stage of the opening of the contacts.

The thermal energy developed by the arc is thus transferred to the volume of gas housed in the cavity in the operating rod with a consequent increase in temperature and pressure which is correlated to the intensity of the electric arc and thus to the current to be interrupted. This excess pressure, which exceeds that present in the compression chamber, brings about a flow of gas towards the compression chamber, also increasing the temperature and pressure therein.

When the nozzle of the arcing chamber is opened, a vigorous flow of gas through the nozzle is initiated and increases much more quickly than in a conventional double-flow interrupter by virtue of the greater pressure developed in the compression chamber.

This flow can adapt to the intensity of the arc current to some extent.

During the final stage of the opening travel of the contacts, the cavity in the operating rod is then opened towards the space in the casing and enables a second flow to develop through the arcing chamber and towards the space in the casing.

With this solution also, however, the flows brought about are not fully synchronous and are concentrated predominantly in the final stage of the operation to open the interrupter.

Moreover, the greater pressure effect brought about by the arc is not optimal since it is based on the flow of gas from the arcing chamber towards the compression chamber. It is known, however, that most of the energy developed by the electric arc (about 80%) is in the form of radiant energy which is converted into heat by absorption due to the imperfect reflectivity of the surfaces and the imperfect transparency of the gas. Most of the radiant energy is thus unused and results in heating of the internal surface of the arcing chamber.

The distribution of the flows over time is therefore not optimal and their two-directional distribution is also not amongst the most effective and this has adverse effects in terms of the larger volume of the compression chamber and the greater operating power required.

SUMMARY OF THE INVENTION

The present invention solves these problems and provides a high-tension interrupter which optimizes the distribution of the flows over timer concentrating it practically uniformly within an arc-extinguishing time interval preceded by a predetermined minimum arcing time after the expiry of which the optimal conditions required for extinguishing the arc are achieved very quickly.

These results are achieved by a high-tension interrupter in which a compression chamber is associated with a suction chamber, the two chambers being put into communication with one another by means of an arcing chamber formed in a hollow actuator rod at a predetermined moment after the operation to open the contacts, corresponding to a predetermined position of the open contacts and to a predetermined minimum arcing time.

According to a further aspect of the present invention, the hollow actuator rod advantageously puts the arcing chamber into communication with the compression chamber during the opening of the contacts and before the two chambers, that is, the compression chamber and the suction chamber, are put into communication with one another, so that the energy developed by the arc is recovered and converted into an increase in pressure in the compression chamber.

In order to optimize this effect, the arcing chamber is advantageously formed with an optical cavity in order to transmit most of the arc radiation into the compression chamber.

According to a further aspect of the present invention, a one-way valve connects the suction chamber to the compression chamber as a result of a slight excess relative pressure between the suction chamber and the compression chamber, so that the closure of the interrupter takes place with a minimal resisting pressure induced in the chambers and with a minimal intervention and working power required.

BRIEF DESCRIPTION OF THE DRAWINGS

The characteristics and advantages of the invention will become clearer from the following description of a preferred embodiment of a high-tension interrupter and from the appended drawings in which.

DETAILED DESCRIPTION

Figure 1:
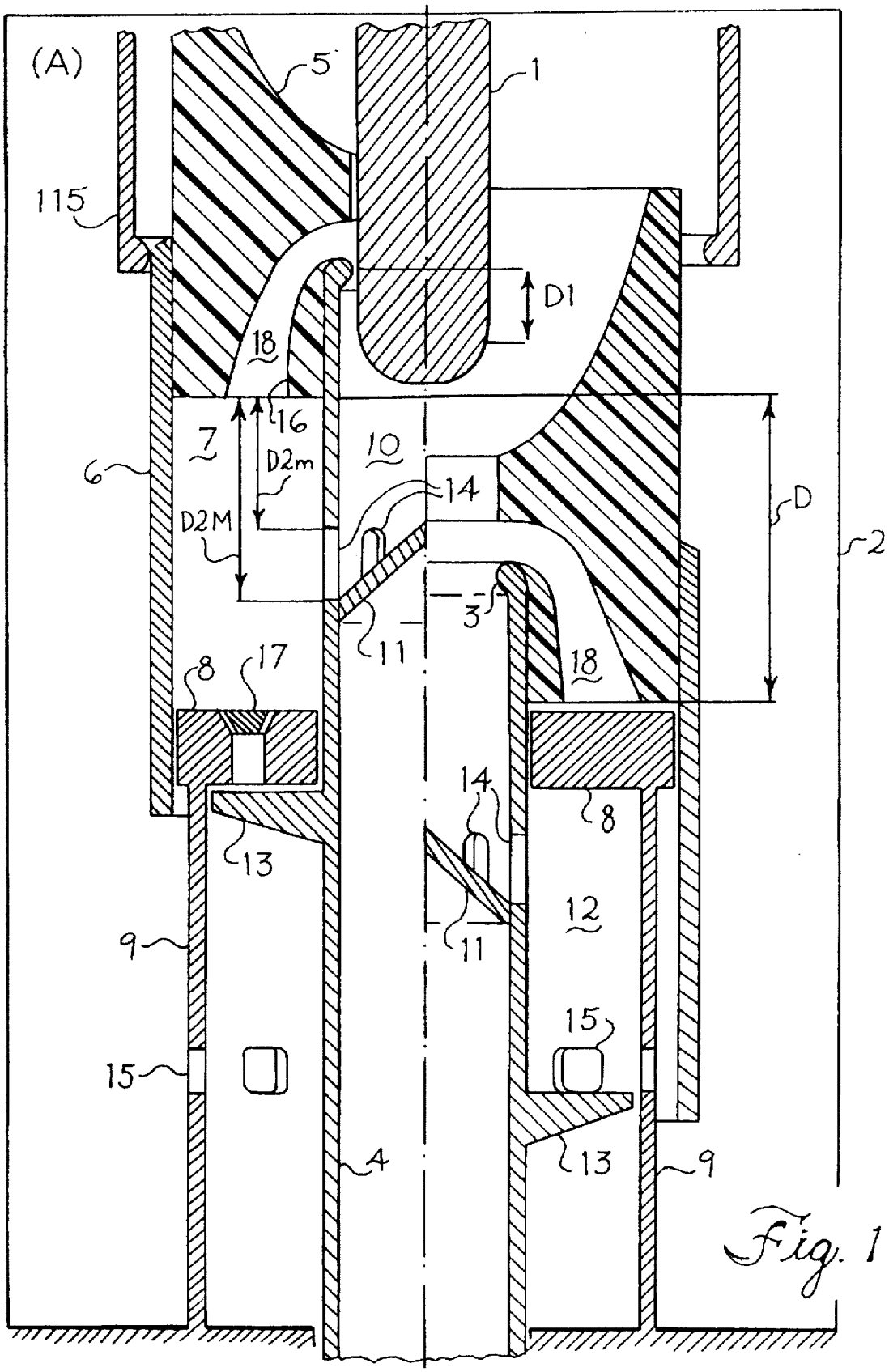
FIG. 1 is a diametral, vertical section of a preferred embodiment of an interrupter according to the present invention in the closed position, shown on the left-hand side of the central vertical axis of the drawing, and in the position in which the contacts are furthest open, shown on the right-hand side of the central vertical axis of the drawing, respectively.

With reference to FIG. 1, an interrupter formed according to the present invention comprises, housed in a casing 2 which is preferably cylindrical and defines a casing space filled with dielectric gas such as sulphur hexafluoride ($SF_6$) under pressure; a fixed arcing contact 1 and a movable assembly comprising a movable arcing contact 3 which slides on the end of the fixed arcing contact 1 and is carried by the end of a cylindrical, axially slidable, operating rod 4, a nozzle 5 of insulating material, fixed to the rod 4, and a cylinder 6, fixed to the rod 4 and defining, together with the nozzle 5 and the rod 4, a compression chamber 7 of variable volume, closed by a fixed piston 8 fixed to a cylindrical support 9 coaxial with the rod 4 and with the cylinder 6.

The operating rod 4 is hollow, at least in its part nearest the movable arcing contact 3, and forms a cylindrical arc-confinement chamber or arcing chamber 10 which is closed at one end by the fixed arcing contact 1 when the interrupter is closed, and is closed at the other end by a diaphragm 11 which is conical or frustoconical with its vertex oriented towards the fixed arcing contact 1 or, as will be seen below, advantageously, is shaped as a multiple parabolic optical reflector.

The cylindrical support 9, together with the piston 8, forms a second cylindrical chamber 12 closed by a movable piston 13 fixed to the rod 4.

As the movable piston 13 moves away from the fixed piston 8, it increases the volume of the chamber 12 which is thus subject to a vacuum.

The chamber 12 is called the suction chamber.

Radial holes 14 in the cylindrical wall of the rod 4 near the diaphragm 11 put the arcing chamber 10 into communication with the space outside the rod 4.

When, as shown in FIG. 1(A), the interrupter is closed, the radial holes 14 put the arcing chamber 10 into communication with the compression chamber 7.

When, as shown in FIG. 1(B), the interrupter is open, the radial holes 14 put the arcing chamber 10 into communication with the suction chamber 12.

Radial holes 15 in the cylindrical support 9 of the fixed piston 8 put the suction chamber 12 into communication with the space in the casing 2 outside the cylinder 9 when, as shown in FIG. 1(B), the interrupter is opened to the position in which the contacts are farthest apart.

The interrupter is completed by filed current contacts 115 which, when the interrupter is closed, are in electrical contact with a movable current contact formed, for example, by the cylinder 6 which defines the compression chamber, by a screen 16 of insulating material which surrounds the movable contact 3 and, together with the nozzle 5, forms converging outflow ducts 18 from the compression chamber towards the neck of the nozzle 5, and by a one-way valve 17 (or several valves) which puts the suction chamber 12 into communication with the compression chamber 7, through the piston 8, when the suction chamber 12 is under excess pressure in comparison with the chamber 7.

The interrupter of FIG. 1 is opened by a travel of the movable parts relative to the fixed contact, represented by the axial distance D between the position of the ceiling of the compression chamber 7 formed by the nozzle 5 when the interrupter is closed, and the position of the ceiling of the compression chamber when the interrupter is fully open.

The distance D advantageously, but not necessarily, also represents essentially the maximum axial lengths of the compression chamber 7 and of the suction chamber 12.

This means that, when the interrupter is fully open, the volume of the compression chamber is essentially zero and all of the gas housed in the compression chamber has been expelled.

When the interrupter is closed, the volume of the compression chamber 12 is essentially zero.

This means that, in the absence of infiltrations of gas through seals, not shown, virtually zero pressure is created in the suction chamber since the relative change of volume of the suction chamber as a result of the opening of the interrupter is virtually infinite.

Figure 2:
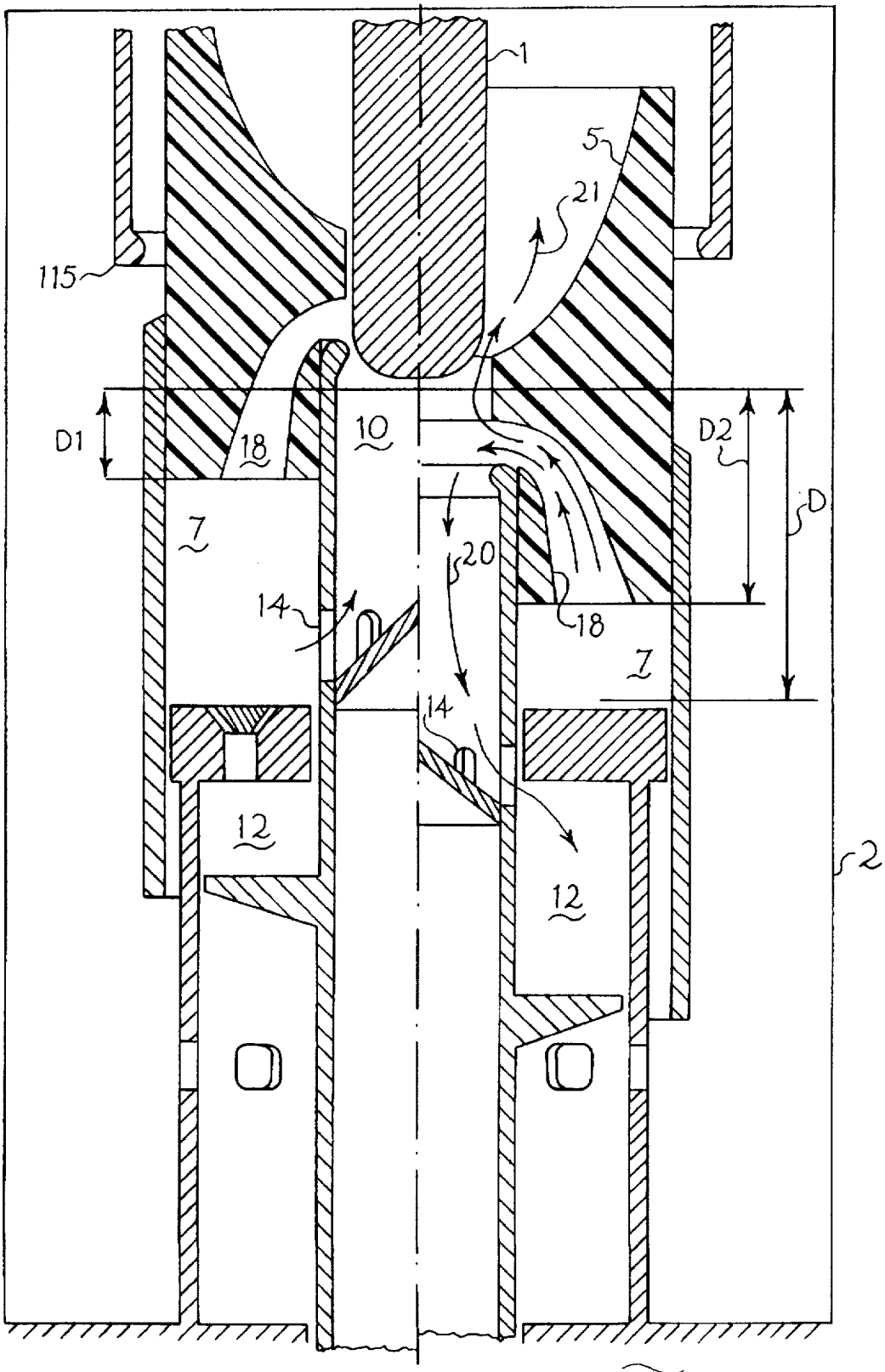
FIG. 2 is a diametral, vertical section of the interrupter of FIG. 1 in the position and at the moment in time corresponding to the separation of the contacts, on the left-hand side of the central vertical axis of the drawing, and in the position and at the moment time corresponding to the minimum arcing time, on the right-hand side of the central vertical axis of the drawing, respectively.

Amongst the various positions which the movable assembly adopts as it moves from the position in which the interrupter is closed, shown in FIG. 1(A) to the position in which the interrupter is open, shown in FIG. 1(B), it is appropriate to identify and define some intermediate positions, shown in FIG. 2.

Since there is a univocal relationship between the various positions and the moments at which they occur, defined by the space-time equation of motion which is monotonic, the intermediate positions are identified in terms of time:

The time TC at which the contacts are opened:

Is the moment at which the movable contact 3 is separated from the fixed contact 1 with reference to the moment at which the operation of the interrupter was initiated and, in geometrical terms, corresponds to a travel D1 of the movable contact equal, for example, to 25% of the total travel D.

The position corresponding to this moment is shown in FIG. 2 on the left-hand side of the vertical central axis and shows that the nozzle 5 is completely obstructed by the fixed contact 1 (except for a minimum clearance) and that the arcing chamber 10 is in communication with the compression chamber 7 through the holes 14.

The holes 14 are, in fact, advantageously disposed between two distances D2m and D2M from the ceiling of the compression chamber, these distances being less than the distance D–D1, that is, D–D1>D2M>D2m.

The compression chamber is therefore not in communication with the space in the casing 2 and its reduction in volume (of the order of 25%) involves an increase in the pressure of the gas housed therein, some of which flows through the holes 14 into the arcing chamber 10, the volume of which tends to increase during the opening operation.

The increase in pressure in the compression chamber causes no substantial flow of gas through the nozzle 5 since this is obstructed by the fixed contact.

The minimum arcing time TAM or, more properly, the minimum time of arcing: is the moment at which gas-flow conditions which enable the arc formed between the fixed contact and the movable contact to be extinguished are achieved in the interrupter.

In known interrupters this is a greatly variable parameter.

In the interrupter of the present invention, however, TAM corresponds to a certain geometrical position of the movable contact shown in FIG. 2 (on the right-hand side of the central vertical axis), equal to a travel D2 of the order of 70–75% of D.

In this position, the nozzle 5 starts to be opened as a result of the relative movement between the fixed contact and the nozzle 5 and the holes 14 have passed a certain distance beyond the piston 8 putting the arcing chamber 10 and the suction chamber 12 into communication. The compression chamber 7, on the other hand, is no longer in communication with the arcing chamber through the holes 14 but through the converging outflow ducts formed between the nozzle 5 and the insulating screen 16.

The operation of the interrupter in its various stages of operation and the advantageous effects achieved will now be explained further with reference to the time graphs of FIGS. 3 to 6.

Figure 3:
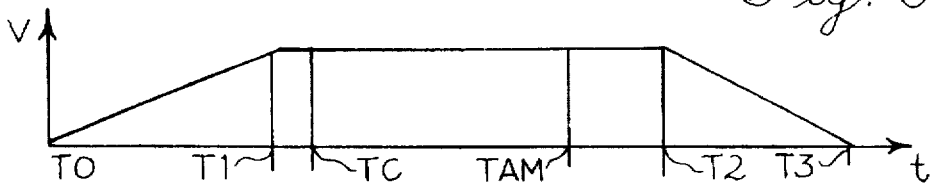
FIG. 3 is a time graph illustrating qualitatively the speed-time equation of motion of the interrupter of FIG. 1.
Figure 4:
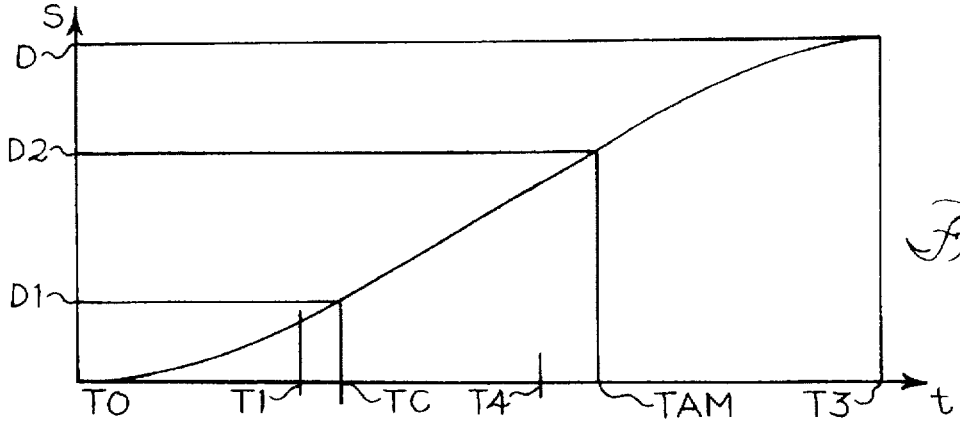
FIG. 4 is a time graph illustrating qualitatively the space-time equation of motion of the interrupter of FIG. 1.

FIGS. 3 and 4 show the speed-time and space-time equations of motion which govern the operation to open the interrupter of FIG. 1, respectively.

During a first time interval T0–T1 of the order of 8–10 ms, the speed increases linearly from zero to a working value of the order of 10 m/s which remains constant for a time interval of the order of 10–14 ms.

This interval is followed by a time interval T2–T3 in which the speed decreases to 0.

The geometrical dimensions of the interrupter are such that the arcing time TC is immediately after the time T1 or coincides therewith and the minimum arcing time TAM is before the time T2.

Figure 5:
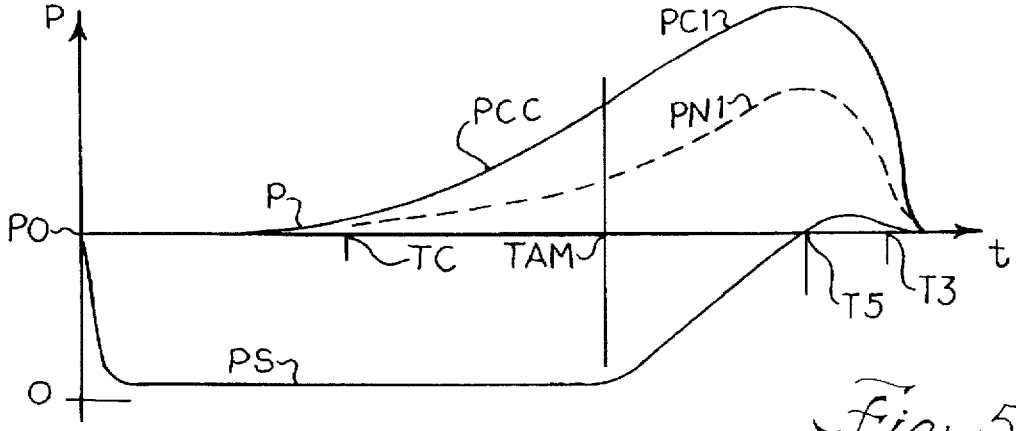
FIG. 5 is a qualitative time graph of the pressures and vacuums developed in the compression and suction chambers of the interrupter of FIG. 1, respectively, during an opening operation, and relative to the nominal working pressure of the interrupter.

FIG. 5 shows qualitatively the excess pressure and vacuum phenomena which develop in the compression chamber 7 and in the suction chamber 12, respectively.

It is clear that, in the time interval T0–TC, the compression chamber undergoes a fairly small change (a decrease in volume) of the order of 20–25%. This change is partly balanced by the increase in volume of the arcing chamber 10 with which the compression chamber communicates through the holes 14 and, to a certain extent, also through the ducts 18 and the movable contact which is necessarily not constituted by a continuous ring but by a plurality of separate contacts or a contact "tulip".

The pressure of the gas in the compression chamber which is initially at a value P0 (of the order of 6 Bars) and is shown by the graph P consequently increases to a negligible extent much less than the compression ratio developed at the time TC.

At this stage there are also slight leakages of fluid through the nozzle 5 which is closed by the fixed contact 1 with a certain free clearance.

The behaviour of the expansion chamber 12, in which an increase in volume occurs with a virtually infinite expansion ratio, is completely different.

In the absence of leakages, the pressure in the chamber 12 would fall abruptly to 0 and would remain at zero as long as the chamber were not in communication with an environment at a higher pressure.

As a result of the inevitable leakages, the pressure curve is as shown qualitatively by the graph PS.

When an absolute minimum pressure very near to 0 has been reached, this is maintained throughout and beyond the interval T0–TC.

When the contacts open at the time TC, an electric arc is struck between the contacts, with a voltage drop in the arc which is variable between a few hundred of volts and a few Kv in dependence on the distance between the contacts.

A considerable dissipation of electrical power thus takes place, in dependence on the arc current, predominantly in the form of radiated thermal energy.

The energy, which is radiated predominantly in the arcing chamber, heats the gas housed therein and increases its pressure.

The diaphragm 11 closing the arcing chamber acts as a radiation reflector so that a large portion of the arc radiation is transmitted through the holes 14 to the gas housed in the compression chamber, which is also heated.

The amount of radiation and its distribution over time depend on the intensity of the current and on the phase relationship between the opening of the contacts and the current wave.

The operation of the interrupter is in fact not synchronized with the alternating current to be interrupted, which may have any value at the moment TC.

In any case, in the presence of a short-circuit current, the arc energy is converted into a considerable increase in the pressure of the compressed gas present in the compression chamber, which can be estimated as 100% of the excess pressure brought about solely by the change of volume of the compression chamber.

The cumulative change in the pressure of the gas in the compression chamber is shown qualitatively by the graph PCC which extends almost up to the minimum arcing time TAM.

In fact, during the time interval TC, Td, if T4 is slightly before TAM, the holes 14 keep the arcing chamber in communication with the compression chamber.

It is appropriate to point out that, at this stage, the arc radiation which is also absorbed partially and locally by the non-metallic parts such as the neck 5A of the nozzle 5 and the insulating screen 16, causes surface evaporation of these parts and the formation of a gas bubble with a very high temperature and correspondingly very low density, which virtually obstructs the lines between the neck of the nozzle and the fixed contact 1.

There is therefore no leakage of the flow towards the space in the casing.

This is not the case with arcs developed by weak currents, that is, currents equal to or less than the nominal operating currents.

In this case, the energy dissipated by the electric arc is slight and the increase of pressure in the compression chamber is due essentially solely to the change in volume of the chamber.

The change in pressure in the chamber is shown qualitatively by the graph PN which is much flatter than the previous one.

This excess pressure gives rise to a small gas flow from the compression chamber to the arc-extinguishing chamber through the holes 14 and the ducts 18 and from there towards the space in the casing through the hole between the neck of the nozzle 5 and the fixed contact 1.

This flow effectively extinguishes the arc in conditions of maximum speed of movement apart of the contacts (even with an arcing time less than the minimum arcing time) so that the risk of re-striking of the arc is excluded.

From the time T4 to the minimum arcing time TAM for a very short time interval of less than 1 ms, which depends on the axial dimension of the piston 8 and the axial lengths of the holes 14 which, in any case, are less than the axial dimension of the piston 8, further travel of the operating rod 4 causes simultaneous obstruction of the holes 14 and their subsequent opening towards the suction chamber 12 at or immediately before the time TAM.

The compressed gas housed in the chamber 7 can thus flow through the ducts 18 towards the arcing chamber 10 and from there towards the suction chamber 12.

The simultaneous opening of the neck of the nozzle 4 which is no longer obstructed by the fixed contact 1 also allows the gas housed in the arcing chamber 10 to flow towards the ambient space in the casing 2.

Two gas flows, shown by the arrows 20, 21 in FIG. 2D are thus established.

Figure 6:
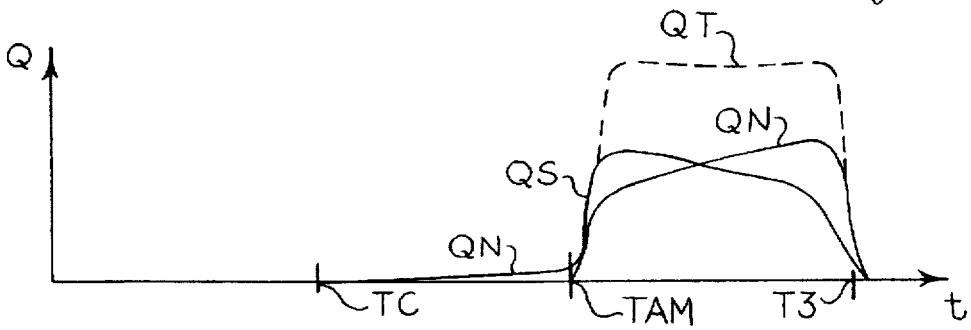
FIG. 6 is a qualitative time graph of the mass flow of the puffs of dielectric gas developed during the opening of the interrupter of FIG. 1.

These flows are shown in FIG. 6 by the graphs QS (the flow through the hollow movable contact) and QN (the nozzle flow) which show qualitatively the mass flows of the two streams.

The magnitudes of the two flows are determined essentially by the pressure difference existing between the compression chamber and the suction chamber.

This pressure difference is particularly high because it is due to the excess pressure in the compression chamber intensified by the thermal effect of the arc, and to the vacuum present in the suction chamber which is still at its absolute maximum value.

Two particularly intense flows QS and QN are thus established in a practically instantaneous manner, limited solely by the inertia of the fluid and by the speed of propagation of the pressure/vacuum wave, one flow QS decreasing with time as a result of the gradual filling of the suction chamber which is not offset by a corresponding increase of volume, and the other flow QN increasing with time as a result of the reduction in the volume of the compression chamber with an ever higher instantaneous volumetric compression ratio dV/V, even if the instantaneous change in volume dV/dt decreases.

Finally, during the time interval TAM, T3, the pressure in the compression chamber varies qualitatively as shown in FIG. 5 by the graph PC1 (in the case of the interruption of high-intensity current) or PN1 in the case of weak-intensity current, and the pressure in the suction chamber varies according to the graph PS, quickly reaching a value near or equal to the ambient pressure of the space in the casing 2 which is reached at a time T5 slightly before the time T3 at which the interrupter is fully open.

To prevent the pressure differential between the compression chamber and the suction chamber being reduced as a result of the further filling of the suction chamber, the exhaust holes 15 (FIG. 1) are advantageously disposed along the travel of the piston 13 so that the suction chamber 12 is put into communication with the space in the casing at least starting from the time T5.

A slight excess pressure in the suction chamber relative to the pressure in the space in the casing thus produces a gas flow from the suction chamber towards the exterior, which limits the excess pressure and enables the flow Qs to be maintained, even though it is decreasing, until the interrupter is fully open.

With suitable dimensions of the cross-section of the suction chamber so as to have a volumetric ratio very close to 1 between the suction chamber and the compression chamber, the suction chamber may also be kept at a vacuum relative to the casing pressure until the interrupter is fully open (time T3).

In this case, a reverse flow towards the suction chamber through the exhaust holes 15 is developed during the final opening stage.

In both cases, upon completion of the opening operation, the diffusion of hot gas housed in the suction chamber towards the exterior and its mixing with the cold gas in the casing space with consequent cooling of the suction chamber are ensured.

In conclusion, it may be pointed out that, except for negligible fluid leakages, the entire volume of the gas initially present in the compression chamber is used to produce two arc-extinguishing flows which are discharged partly into the casing space 2 and partly into the suction chamber.

The flows are concentrated in a limited time interval between the minimum arcing time TAM and the time T3 at which the interrupter is fully open and give rise to a particularly high maximum cumulative flow rate QT=QS+QN with a substantially constant flow throughout the time interval TAM, T3.

The interrupter can thus perform an effective and constant arc-extinguishing action at some moment in time between TAM and T3 when the arc current passes through its natural zero, which event is completely asynchronous with the opening of the interrupter.

For a more clear appreciation of the advantages offered by the interrupter of the present invention over known interrupters, FIGS. 7, 8, 9, 10 show, in comparative form, the mass flows developed by interrupters of various types having compression chambers of equal volume, the same travel and the same equations of motion.

An opening operation with high-intensity currents is considered since this is the most important operation.

Moreover, for simplification, as long as the contacts are closed they are considered leakproof, as is the nozzle, as long as it is closed.

Figure 7:
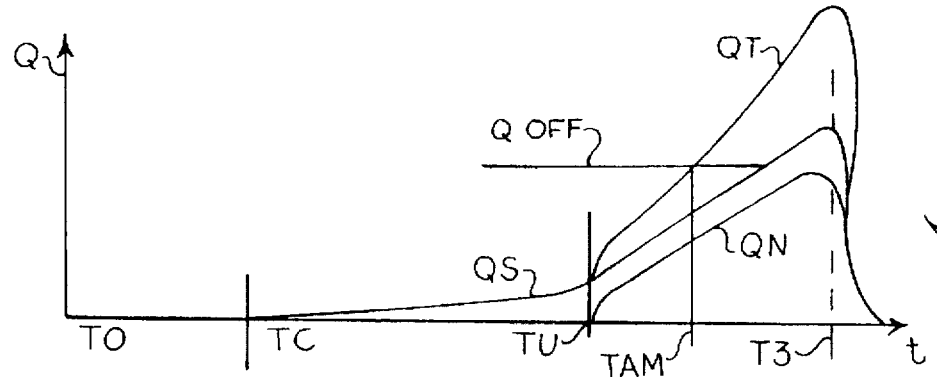
FIG. 7 is a qualitative time graph of the mass flows developed in a conventional double-flow puffer interrupter for comparison with those developed in an interrupter formed according to the present invention.

FIG. 7 shows the mass flow developed by a conventional double-flow puffer interrupter.

Figure 8:
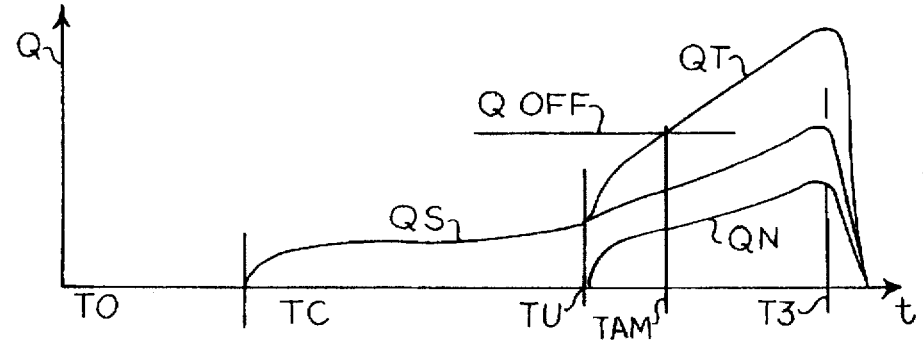
FIG. 8 is a qualitative time graph of the mass flows developed in an interrupter of the type known as a puffer and suction-chamber interrupter, for comparison with those developed in an interrupter formed according to the present invention.

FIG. 8 shows the flow developed by an interrupter with suction/compression chambers.

Figure 9:
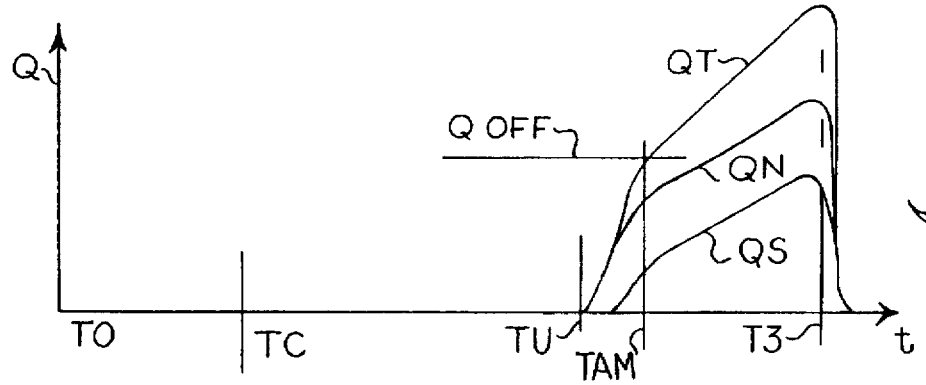
FIG. 9 is a qualitative time graph of the mass flows developed in an interrupter of the type known as a hybrid interrupter, for comparison with those developed in an interrupter formed according to the present invention.
Figure 10:
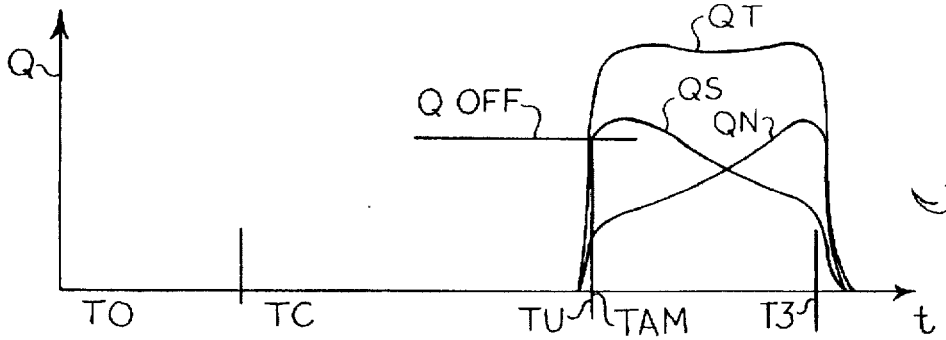
FIG. 10 is a qualitative graph of the mass flows developed in the interrupter of FIG. 1 on a scale standardized with those of FIGS. 7, 8, and 9.

FIG. 9 shows the flow developed by a hybrid interrupter and, finally, FIG. 10 shows the flow developed by an interrupter formed according to the present invention.

It is clear that the cumulative flow graphs in the various cases should have the same area since in all cases $\int QT \cdot dt = VOL$ where VOL is the volume of the compression chamber.

In then the case of a double-flow puffer interrupter (FIG. 7), a flow QS is initiated in the rod from the time TC.

AT the moment TU at which the nozzle starts to open, an increasing nozzle puff QN is initiated and is added to that of the rod. The cumulative flow QT between TU and the time T3 increases substantially linearly. The useful extinguishing flow QOFF is therefore achieved at a time TAM long after TU.

In the case of an interrupter with a suction chamber (FIG. 8), a steady suction flow QS (due to the suction chamber) is initiated from the time TC and a nozzle flow QN is initiated at the time TU.

The cumulative flow increases linearly from the time TU starting from a higher base and with a lesser gradient than in the previous case.

Owing to the contribution due to the flow QS, the useful extinguishing flow is achieved more rapidly than in the previous case at a time TAM which is closer to TU.

In the case of a hybrid interrupter, starting from the time TU, two flows QN and QS are initiated rapidly with very high initial flow gradients which then decrease with an almost trapezoidal curve of the flow QT. The useful extinguishing flow QOFF is achieved at a time TAM closer to TU, as in the case of the interrupter with a suction chamber.

However, in all of these cases, the volume of gas removed from the compression chamber before the minimum arcing time is wasted because it cannot perform any effective action to extinguish the arc.

Moreover, the volume of the gas removed from the compression chamber and corresponding to the excess flow relative to the useful extinguishing flow QOFF is also wasted.

The behaviour of the interrupter according to the present invention is completely different.

At the time TU two flows QN and QS are simultaneously initiated with extremely high flow gradients due to the combined effects of the suction chamber and of the thermal supercompression of the gas in the compression chamber so that the useful extinguishing flow condition QOFF is achieved almost instantaneously at a time TAM which practically coincides with TU.

Moreover, the two flows QN and QS which increase and decrease with time, respectively, give rise to a cumulative flow which is almost uniform over time because the vacuum in the suction chamber decreases, compensating for the increase in pressure in the compression chamber, keeping the pressure differential between the two chambers at a substantially constant level.

Thus, not only are gas wastages before the minimum arcing time TAM avoided, but it is also possible for the dimensions of the compression chamber and, correspondingly, of the suction chamber to be such that the pratically constant cumulative flow is equal to or a little greater than the effective extinguishing flow QOFF.

This involves a substantial reduction in the volume and hence in the cross-section of the compression chamber for a given travel of the movable contact, with a reduction in bulk, in inertial masses, and in the resisting forces exerted, in comparison with solutions known in the art.

This achieves a faster speed of operation for a given interrupter-operating power or, alternatively, the use of less powerful and thus less expensive actuator devices for a given speed of operation.

A further important aspect is that the advance of the minimum arcing time TAM relative to the time T3 when the interrupter is fully open defines a useful arc-extinguishing interval or "fault clearable interval" which is longer the greater the advance of TAM.

The useful arc-extinguishing interval is not a variable parameter but is a predetermined design condition which depends upon the working conditions.

In an interrupter which is intended to operate in a network with a voltage alternating at 50 Hz, the useful arc-extinguishing interval has to be a little greater than 10 ms which is a half-period of a voltage and current wave.

If this requirement is satisfied, it is certain that even when the zero of the current to be interrupted occurs immediately before the minimum arcing time (and the current is thus not interrupted) the current will return to its natural zero value at a time within the useful arc-extinguishing interval and will be interrupted effectively.

It is therefore clear from a comparison of FIGS. 7 to 10 that the same useful arc-extinguishing interval is achieved for a given effective extinguishing flow with a much smaller volumetric capacity of the compression chamber.

It is also clear that, for a given overall operation time of the interrupter which is determined by the inertia of the interrupter and by the power of the actuators available, the more the minimum arcing time is advanced, the more the time interval between the moment at which the operation starts as a result of the recognition of the event which brings it about and the moment at which the current is interrupted is reduced, thus reducing damage which might be caused by the delay in interruption.

To complete the description, it is appropriate to consider the behaviour of the interrupter during closure.

At a first stage of the closure operation, the volume of gas housed in the suction chamber can flow to the exterior through the holes 15 and towards the arcing chamber through the holes 14.

At the same time, gas can flow into the compression chamber (which, during the closure operation operates as a suction chamber) through the neck of the nozzle 5, which is open, and through the ducts 18.

When the holes 15 and 14 are obstructed, a slight excess pressure in the chamber 12 relative to the compression chamber (which during the closure of the interrupter acts as a suction chamber) then brings about opening of the valve 17 and the transfer of a volume of gas from the chamber 12 to the chamber 7.

The closure of the interrupter is therefore carried out in conditions in which resisting forces are negligible and with minimal power and work, so that the closure operation can also be particularly quick.

It was underlined above that the efficiency of the operation of the interrupter is raised by making optimal use of the arc radiation to heat the gas in the compression chamber.

For this purpose, the arcing chamber is formed so as to constitute an optical cavity, preferably with metallic surfaces rendered mirror-like by lapping processes and the like and reflectors which transmit the radiation towards the compression chamber through the holes 14.

Figure 11:
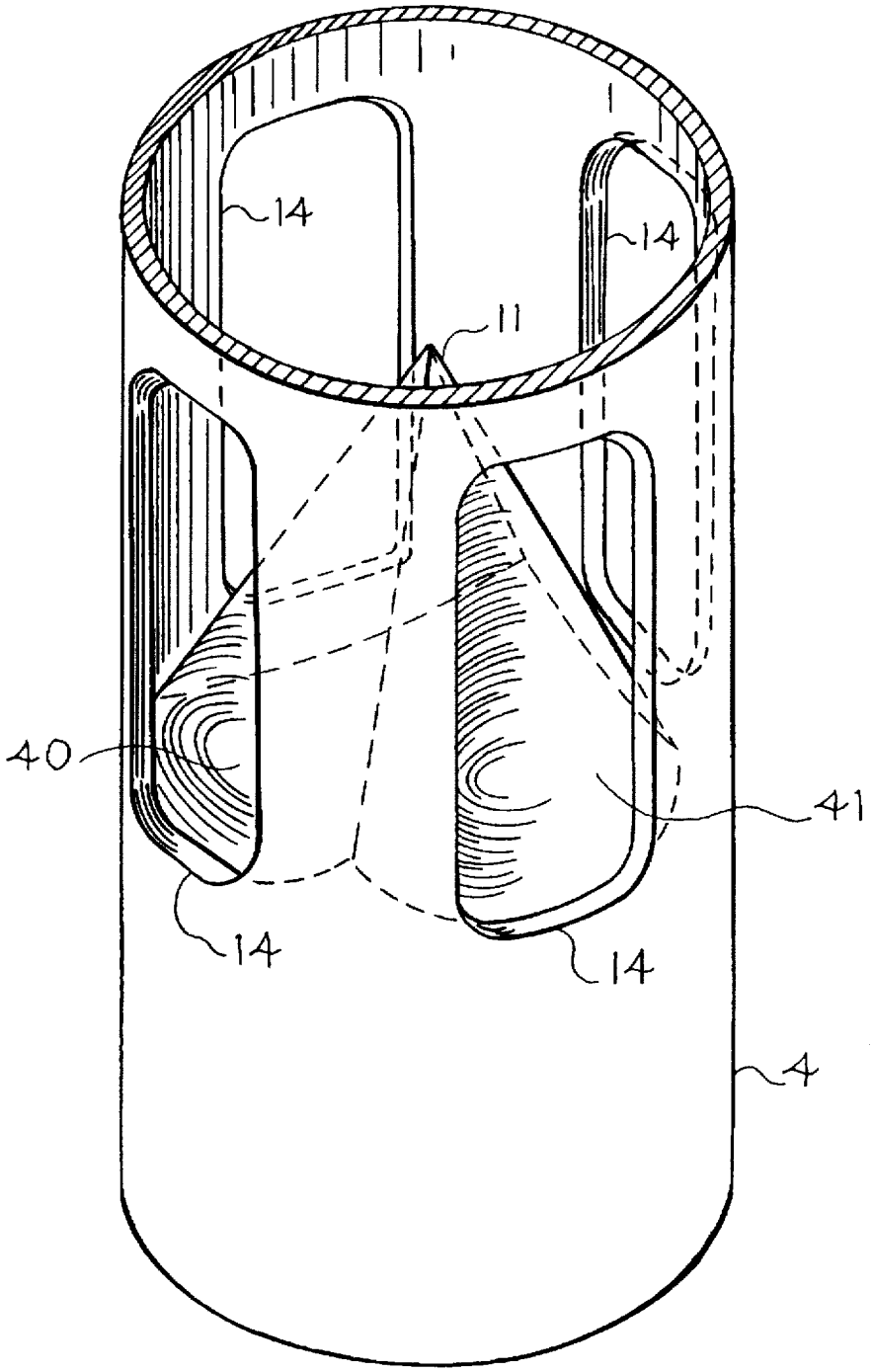
FIG. 11 is a perspective view showing a portion of an actuator rod for the interrupter of FIG. 1 which intensifies the effect of direct radiation and the consequent heating of the gas housed in the compression chamber by the radiation generated by the electric arc.

FIG. 11 is a perspective view of a portion of the operating rod 4 showing a preferred embodiment of the diaphragm 14 which closes the arcing chamber.

Clearly, the radial holes 14 for communication between the arcing chamber and the compression chamber cannot constitute a continuous annular hole because mechanical continuity with sufficient mechanical strength has to be ensured between the part of the rod which is disposed above the holes and that disposed below them. For this reason, the various holes 14 (four in FIG. 11) are separated by upright elements connecting the upper and lower portions of the rod and having dimensions and a screening effect on the arc radiation equal to or even greater than the radiating section offered by the holes 14.

For this reason, the diaphragm 11, which is disposed at the bases of the holes 14, is advantageously shaped like a pyramid with a number of faces 40, 41 with concavities shaped like paraboloids of revolution equal to the number of holes 14 and facing them. The axis of each parabolid of revolution is preferably oriented in the same direction as the axis of the operating rod or diverges therefrom by an angle no greater than 30%. Moreover, the focus of each paraboloid is located in the plane of an associated hole 14 or slightly outside the outer cylindrical surface of the rod.

Most of the arc radiation which, in the arcing chamber, is radiated substantially along the axis of the chamber, is thus focused into the compression chamber where it is absorbed by the gas housed therein.

Alternatively, the upright connecting elements between the upper and lower parts of the operating rod could be constituted by vertical connecting plates disposed radially instead of by the cylindrical wall of the rod, so as to reduce the screening effect to a minimum.

This solution is to some extent more effective but is structurally much more complex and expensive because the perfect axial alignment of the two portions thus connected has to be ensured.

The foregoing description refers to a fixed contact and to a movable system but, clearly, the roles of the fixed contact and of the movable system may be exchanged or even shared, both of the arcing contacts being movable relative to a casing. The expressions fixed contact and movable contact should therefore be interpreted as relating to a reference element and to an element movable relative to the reference element.

We claim:

1. A gas-dielectric high-tension interrupter of the arc-puffer type, comprising:

a first fixed contact and a contact which is movable relative to the fixed contact and is opened by an operating rod in which an arcing chamber is formed, the rod having a predetermined opening travel D, a movable assembly fixed to the rod and comprising an insulating nozzle with a nozzle neck, slidable on the fixed contact, a cylinder forming, with the rod and the nozzle, a compression chamber closed by a first piston which is fixed relative to the fixed contact and is supported by a support cylinder, and a second piston fixed to the rod and movable in the support cylinder, the first fixed piston, the support cylinder, and the movable rod forming a suction chamber closed by the second piston, said rod having holes for communication between the arcing chamber and the compression chamber for positions of the movable rod corresponding to a first fraction of the opening travel, and for communication between the arcing chamber and the suction chamber for positions of the rod corresponding to a second fraction of the opening travel separate from the first fraction.

2. An interrupter according to claim 1 in which said communication holes have a length axially of the rod no greater than the axial dimension of the first piston.

3. An interrupter according to claim 1 or claim 2, in which the second fraction of the opening travel is between a position of the rod in which the neck of the insulating nozzle is completely open into the arcing chamber and the communication holes start to open into the suction chamber and an opening-travel limit position of the rod.

4. An interrupter according to any one of claims 1, 2 in which the arcing chamber is cylindrical and is closed at one end by a cusp-shaped diaphragm with its vertex oriented towards the fixed contact.

5. An interrupter according to any one of claims 1, 2, comprising a plurality of exhaust holes which are formed in the support cylinder and open into the suction chamber, for positions of the movable rod corresponding to a final fraction of the opening travel.

6. An interrupter according to claim 1 or 2, comprising at least one one way flow valve in the first piston, the valve being opened by an excess pressure in the suction chamber relative to the pressure in the compression chamber, thereby putting the suction chamber into communication with the compression chamber.

7. An interrupter according to claim 1 or 2 in which the rod comprises an optical reflector having a plurality of reflective surfaces, each for focusing radiation generated by the arc in the arcing chamber in or beyond one of the communication holes.

8. An interrupter according to claim 7, in which the reflective surfaces are segments of paraboloids of revolution with axes diverging from the axis of the rod by less than 30°.

* * * * *